US008443825B2

(12) United States Patent
Lautzenheiser et al.

(10) Patent No.: US 8,443,825 B2
(45) Date of Patent: May 21, 2013

(54) FAUCET VALVE SYSTEM

(75) Inventors: Terry L. Lautzenheiser, Nunica, MI (US); David O. Godfrey, Lowell, MI (US); Michael E. Miles, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 474 days.

(21) Appl. No.: 12/613,565

(22) Filed: Nov. 6, 2009

(65) Prior Publication Data

US 2010/0116369 A1 May 13, 2010

Related U.S. Application Data

(60) Provisional application No. 61/113,108, filed on Nov. 10, 2008.

(51) Int. Cl.

| | |
|---|---|
| ***G05D 11/00*** | (2006.01) |
| ***F16K 31/14*** | (2006.01) |
| ***F16K 11/20*** | (2006.01) |
| ***F16L 37/56*** | (2006.01) |

(52) U.S. Cl.
USPC ..... 137/87.01; 137/495; 137/594; 137/597

(58) Field of Classification Search
USPC ..... 137/110, 599.14, 599.15, 599.11, 137/87.01, 78.1, 495, 487.5, 505.14, 87.04, 137/544, 597, 594, 505.21, 505.22, 505.38, 137/494, 87.06
See application file for complete search history.

(56) References Cited

U.S. PATENT DOCUMENTS

| | | | | |
|---|---|---|---|---|
| 2,371,720 | A * | 3/1945 | Stine | 422/266 |
| 2,588,186 | A | 3/1952 | Wasson | |
| 3,191,628 | A * | 6/1965 | Kirkwood et al. | 137/625.43 |
| 3,683,961 | A | 8/1972 | Launay et al. | |
| 4,021,343 | A | 5/1977 | Tyler | |
| 4,058,287 | A | 11/1977 | Fromfield | |
| 4,105,555 | A * | 8/1978 | Pease | 210/136 |

(Continued)

FOREIGN PATENT DOCUMENTS

| | | |
|---|---|---|
| CH | 547457 | 3/1974 |
| DE | 3322068 | 12/1984 |

(Continued)

OTHER PUBLICATIONS

International Search Report and Written Opinion, Feb. 5, 2010.

(Continued)

*Primary Examiner* — Stephen M Hepperle
*Assistant Examiner* — Kevin Barss
(74) *Attorney, Agent, or Firm* — Warner Norcross & Judd LLP

(57) ABSTRACT

A valve system enables use of a standard single line faucet with a water treatment system. The valve system may include a housing having ports for receiving untreated supply water, supplying water to a water treatment system, receiving treated water from the water treatment system and supplying treated water to a dispenser. The valve system includes an automatic shutoff device that prevents water from flowing into the water treatment system when the dispensing faucet is closed and allows water to flow into the water treatment system when the faucet is open. The valve system may include a pressure relief mechanism that removes pressure from the water treatment system when the faucet is closed and a check valve for maintaining a desired amount of pressure within the valve system.

12 Claims, 7 Drawing Sheets

U.S. PATENT DOCUMENTS

| | | | | | |
|---|---|---|---|---|---|
| 4,176,063 | A | * | 11/1979 | Tyler | 210/101 |
| 4,361,170 | A | * | 11/1982 | Peloza | 137/625.29 |
| 4,391,712 | A | | 7/1983 | Tyler et al. | |
| 4,405,000 | A | | 9/1983 | Fuller | |
| 4,431,019 | A | * | 2/1984 | Kopp et al. | 137/87.04 |
| 4,535,797 | A | * | 8/1985 | Rosaen | 137/87.03 |
| 4,604,194 | A | | 8/1986 | Entingh | |
| 4,619,436 | A | | 10/1986 | Bonzer et al. | |
| 4,808,302 | A | | 2/1989 | Beall, Jr. | |
| 4,885,085 | A | | 12/1989 | Beall, Jr. | |
| 5,002,664 | A | | 3/1991 | Clack et al. | |
| 5,057,214 | A | * | 10/1991 | Morris | 210/136 |
| 5,096,574 | A | | 3/1992 | Birdsong et al. | |
| 5,128,035 | A | | 7/1992 | Clack et al. | |
| 5,131,277 | A | | 7/1992 | Birdsong et al. | |
| 5,132,017 | A | | 7/1992 | Birdsong et al. | |
| 5,173,178 | A | | 12/1992 | Kawashima et al. | |
| 5,275,193 | A | | 1/1994 | Wright | |
| 5,460,716 | A | | 10/1995 | Wolbers | |
| RE35,252 | E | | 5/1996 | Clack et al. | |
| 5,515,884 | A | | 5/1996 | Danzy et al. | |
| 5,662,793 | A | | 9/1997 | Beall, Jr. | |
| 5,937,903 | A | * | 8/1999 | Afshar et al. | 137/625.46 |
| 5,996,606 | A | * | 12/1999 | Iwasaki et al. | 137/110 |
| 6,007,710 | A | | 12/1999 | Pavel | |
| 6,068,764 | A | * | 5/2000 | Chau | 210/136 |
| 6,085,788 | A | | 7/2000 | Larson et al. | |
| 6,109,288 | A | * | 8/2000 | Al-Hamlan | 137/87.01 |
| 6,186,174 | B1 | * | 2/2001 | Yurchision et al. | 137/625.46 |
| 6,214,214 | B1 | | 4/2001 | Hansen et al. | |
| 6,347,644 | B1 | * | 2/2002 | Channell | 137/597 |
| 6,428,689 | B1 | * | 8/2002 | Kameyama et al. | 210/120 |
| 6,436,282 | B1 | | 8/2002 | Gundrum et al. | |
| 6,568,428 | B2 | * | 5/2003 | Pecci et al. | 137/597 |
| 6,797,156 | B2 | | 9/2004 | Chau | |
| 7,017,611 | B2 | | 3/2006 | Schmitt | |
| 7,182,857 | B2 | | 2/2007 | Koslow et al. | |
| 7,264,731 | B2 | | 9/2007 | Bosko | |
| 7,267,769 | B2 | | 9/2007 | Baird | |
| 7,285,210 | B2 | | 10/2007 | Schmitt | |
| 7,296,585 | B2 | | 11/2007 | Eggleston et al. | |
| 7,303,666 | B1 | | 12/2007 | Mitsis | |
| 7,316,774 | B2 | | 1/2008 | Halemba et al. | |
| 7,402,240 | B2 | | 7/2008 | Kung et al. | |
| 2003/0066340 | A1 | | 4/2003 | Hassenflug | |
| 2003/0183275 | A1 | * | 10/2003 | Yang | 137/98 |
| 2004/0129617 | A1 | * | 7/2004 | Tanner et al. | 210/110 |
| 2004/0161227 | A1 | * | 8/2004 | Baxter | 392/454 |
| 2004/0182455 | A1 | * | 9/2004 | Wells et al. | 137/594 |
| 2004/0206405 | A1 | | 10/2004 | Smith et al. | |
| 2004/0217068 | A1 | | 11/2004 | Kirby | |
| 2005/0087492 | A1 | | 4/2005 | Schmitt | |
| 2005/0115875 | A1 | | 6/2005 | Schmitt | |
| 2005/0173317 | A1 | | 8/2005 | Schmitt | |
| 2006/0000761 | A1 | | 1/2006 | Choi et al. | |
| 2006/0113240 | A1 | * | 6/2006 | Burrows et al. | 210/420 |
| 2007/0074772 | A1 | | 4/2007 | Yang et al. | |
| 2007/0181191 | A1 | | 8/2007 | Wittig et al. | |
| 2007/0256977 | A1 | | 11/2007 | Schmitt | |
| 2007/0262004 | A1 | | 11/2007 | Jordan et al. | |
| 2007/0284245 | A1 | * | 12/2007 | Hegel et al. | 204/280 |
| 2008/0011365 | A1 | * | 1/2008 | Newton et al. | 137/540 |
| 2008/0052094 | A1 | | 2/2008 | Morfopoulos et al. | |

FOREIGN PATENT DOCUMENTS

| | | |
|---|---|---|
| DE | 4031764 | 2/1992 |
| DE | 20013926 | 10/2000 |
| EP | 0796953 | 9/1997 |
| EP | 0803473 | 10/1997 |
| EP | 0898022 | 2/1999 |
| EP | 1757354 | 2/2007 |
| FR | 2441116 | 6/1980 |
| JP | 2107872 | 4/1990 |
| JP | 4025682 | 1/1992 |
| JP | 2004/069039 | 3/2004 |
| KR | 2005017786 | 2/2005 |
| WO | 00/43703 | 7/2000 |

OTHER PUBLICATIONS

International Preliminary Report on Patentability Chapter I (IB/373) including the Written Opinion of the International Search Authority for PCT/US2009/063464, May 10, 2011.

International Search Report and Written Opinion for PCT/US2011/024704, Aug. 4, 2011.

English Abstract of KR 2005017786A.

* cited by examiner

FAUCET VALVE SYSTEM

BACKGROUND OF THE INVENTION

The present invention is directed to supply driven fluid flow systems, and more particularly to a fluid flow system incorporating a water treatment system.

Water treatment systems are well known for providing filtered, treated water. These systems typically include an inlet for receiving untreated water from a supply line, one or more filters for treating the water, and an outlet for the treated water. The treated water outlet may be connected to a faucet that can be opened (i.e. "turned on") to dispense the treated water. Currently, many water treatment systems can only be used with a "three-line" faucet that includes a first line for untreated water supply to the water treatment system, a second line that receives the treated water from the system, and a third line that receives untreated water from a supply source. This configuration serves to limit pressure on the water treatment system when 'waiting' to dispense water, because the water treatment system only experiences pressure when the valve on the faucet is open. Unfortunately, there are only a limited number of styles and options for three-line faucets, creating a need for a system that enables the use of a standard single-line faucet for dispensing treated water from a water treatment system while limiting the pressure on the system.

SUMMARY OF THE INVENTION

The present invention provides a valve system that enables use of a standard single line faucet with a water treatment system. In one embodiment, the valve system includes a housing having ports for: (1) receiving untreated supply water, (2) supplying water to a water treatment system, (3) receiving treated water from the water treatment system and (4) supplying treated water to a dispenser (i.e. a single line faucet). The valve system may additionally include an untreated water outlet port for splitting the supply water between the valve system and an untreated water dispenser.

The valve system includes an automatic shutoff device within the housing that prevents water from flowing into the water treatment system when the dispensing faucet is closed and that allows water to flow into the water treatment system when the faucet is open. The automatic shutoff may operate on a pressure differential between the incoming supply water and the outflow of treated water.

In one embodiment, the valve system further includes a pressure relief mechanism that removes pressure from the water treatment system when the faucet is closed. In this embodiment, the valve system may also include a check valve for maintaining a desired amount of pressure within the valve system for holding the automatic shutoff valve closed. The valve system may additionally include a flow controller for controlling the amount of fluid that flows into the valve system and into the water treatment system.

The faucet valve system of the present invention provides a reliable device that can be inserted in-line with a water treatment system to allow use of a standard single-line faucet with the water treatment system. The valve system also enables easy maintenance of the water treatment system by removing pressure from the system (and removing fluid flow to the system) when the faucet is turned off. Other features and advantages of the invention will become apparent to those skilled in the art upon review of the following detailed description and drawings.

DETAILED DESCRIPTION OF THE CURRENT EMBODIMENTS

Figure 1:
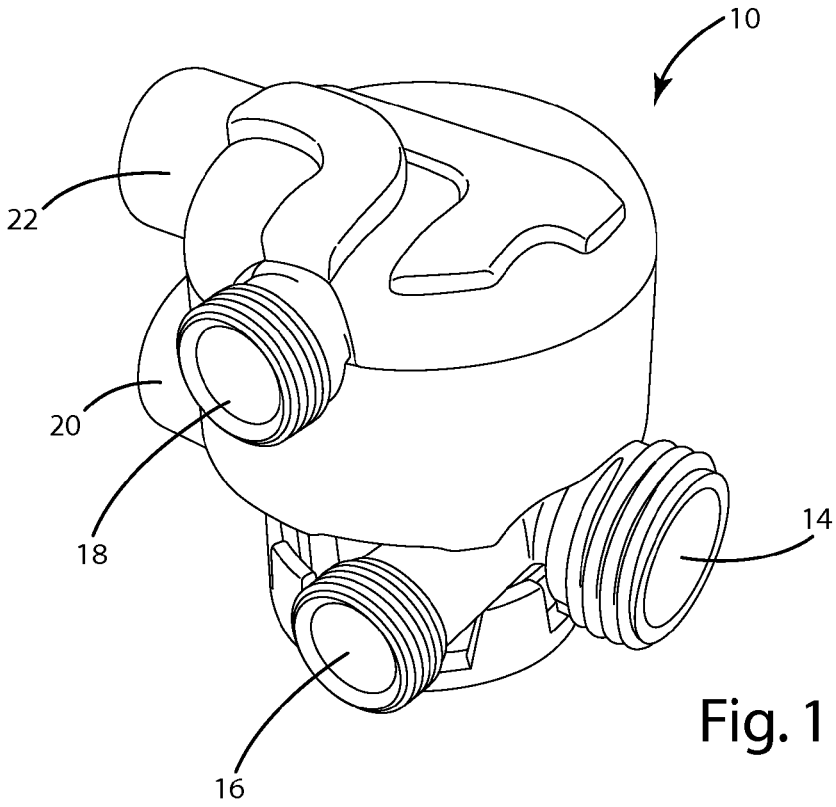
FIG. 1 is a perspective view of the faucet valve system according to one embodiment.
Figure 2:
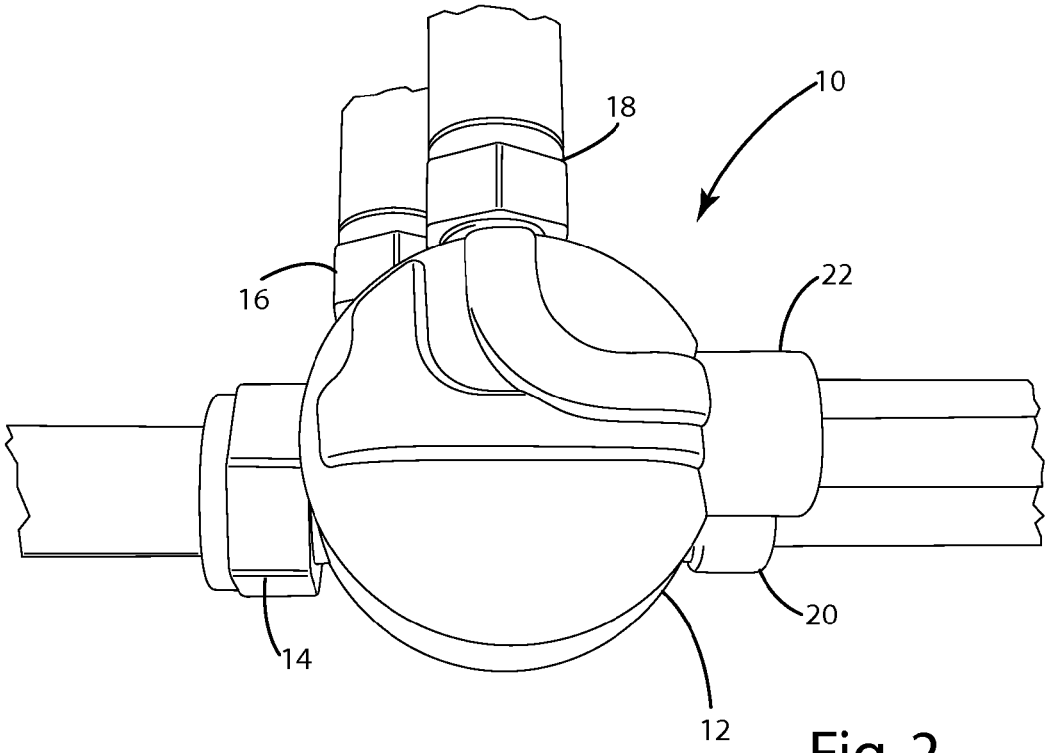
FIG. 2 is a top view of the faucet valve system showing the supply lines connected to the valve system.
Figure 3:
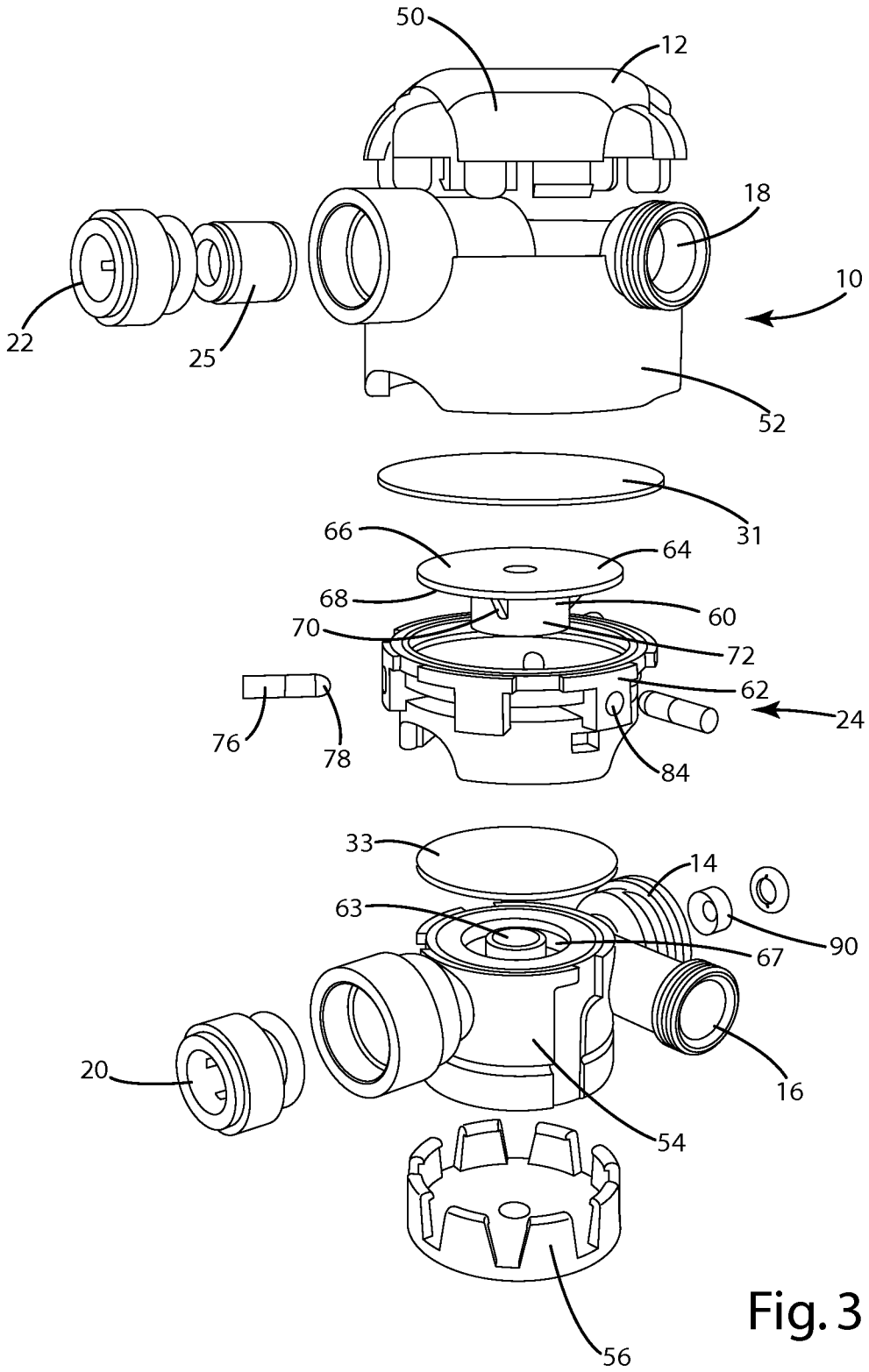
FIG. 3 is an exploded view of the faucet valve system of FIG. 1.

A faucet valve system according to one embodiment of the present invention is shown in FIGS. 1-3 and generally designated 10. The valve system 10 is configured to enable use of a standard single line faucet with a water treatment system, and typically includes a plurality of ports for connecting the valve system 10 to the supply water, the faucet, and a down stream device, such as a water treatment system 11. As illustrated, the faucet valve system 10 includes a housing 12 that has a supply water inlet port 14, an untreated water outlet port 16, a treated water outlet port 18, a water treatment system outlet port 20 and a water treatment system inlet port 22. An automatic shutoff valve 24 is positioned within the housing in fluid communication with the supply water inlet port 14, the treated water outlet port 18, and the water treatment system inlet and outlet ports 20, 22. In one embodiment, the automatic shutoff valve operates on a pressure differential between the supply water inlet 14 and the treated water outlet 18, such that the automatic shutoff allows water to flow through the water treatment system 11 when the supply water is turned on and prevents water from flowing through the water treatment system 11 when the supply water is off. A check valve 25 is positioned within the housing between the water treatment system inlet port 22 and the automatic shutoff 24.

The housing 12 may be formed from a variety of materials, and may include multiple pieces that are interfitted together. In one embodiment, the housing is formed from injection molded plastic, and includes an upper cap 50, an upper body member 52, a lower body member 54 and a bottom cap 56. As shown, the ports are molded integrally with the upper and lower body members, but this is not necessary.

Figure 5:
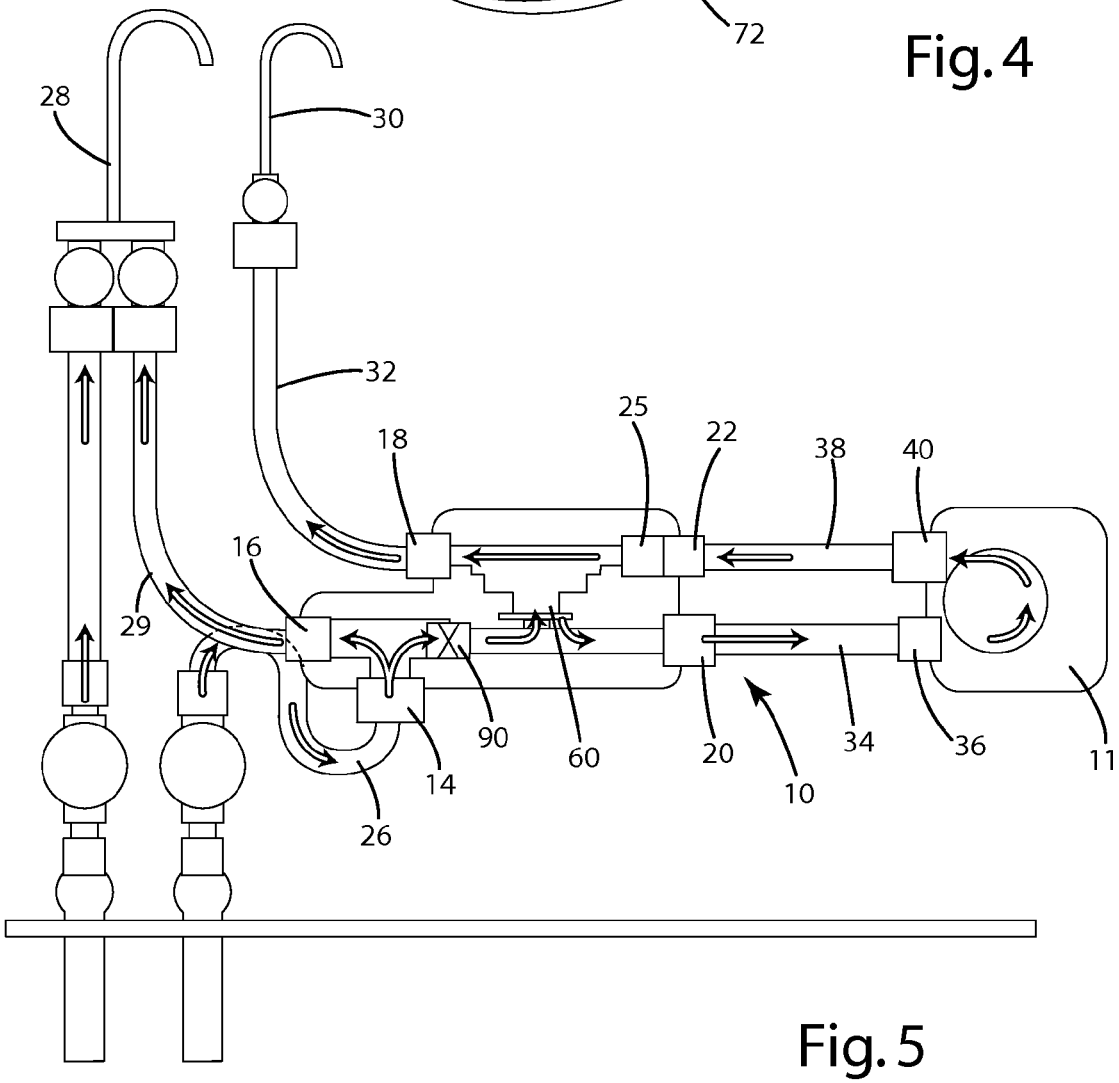
FIG. 5 is a schematic flow diagram showing the fluid flow through the valve system.

FIG. 5 shows the connections between the faucet valve system 10, a first faucet 28 dispensing untreated water and a second faucet 30 that supplies treated water from the water treatment system 11. In the illustrated embodiment, the valve system 10 incorporates an untreated water outlet port 16 in order to facilitate an easy connection to the water supply line 26 by reducing the number of parts that will need to be installed. In this embodiment, the supply line 26 is connected to the supply water inlet port 14, and an untreated water supply line 29 is connected between the untreated water outlet port 16 and the faucet 28. The faucet 28 operates to dispense untreated water in the same manner as it did before the valve system 10 was connected. In another embodiment, the untreated water outlet 16 may not be included on the valve system 10. For instance, a separate, conventional pipe fitting "T" may be connected to the supply line 26, to split the supply water between the untreated faucet 28 and the valve system 10. A treated water supply line 32 is connected between the treated water outlet port 18 and the treated water faucet 30. A water treatment system inlet line 34 is connected between the valve system outlet port 20 and the inlet 36 of the water treatment system, and a water treatment system outlet line 38 is connected between the outlet 40 of the water treatment system and the valve system inlet port 22. In the illustrated embodiment, the supply water inlet port 14 is a ½ inch diameter threaded pipe connector, the untreated 16 and treated 18 water outlet ports are ⅜ inch diameter threaded pipe connectors, the valve system outlet port 20 is a ⅜ inch John Guest connector and the valve system inlet port 22 is a 5/16 inch John Guest connector. In another embodiment any of the ports on the valve system 10 could be a variety of other sizes and connector types depending on the desired application.

In one embodiment, the automatic shutoff valve 24 and the check valve are contained within the housing 12. The check valve 25 may be a conventional check valve that prevents fluid flow in one direction. In the illustrated embodiment, the check valve 25 is positioned near the valve system inlet port 22 to prevent fluid from flowing through the valve system inlet port 22 to the water treatment system 11. The automatic shutoff valve 24 is positioned within the housing 12 in fluid communication with the supply water inlet port 14, the treated water outlet port 18 and the valve system inlet and outlet ports 20, 22. As illustrated in FIG. 3, the automatic shutoff generally includes a plunger 60 supported within a plunger ring 62. The plunger 60 includes a plate 64, having an upper surface 66 and a lower surface 68, and a base 70 extending from the plate 64. In the illustrated embodiment, the plate 64 is circular in shape, and the base 70 has a generally cylindrical sidewall 72. The plunger 60 is mounted within the plunger ring 62 such that it is movable between an open position in which the plate 64 is shifted toward the upper body member 52 with a gap between the base 70 and the lower body member, and a closed position in which the base 70 contacts the lower body member 54. In the open position, the automatic shutoff 24 allows water (or another fluid) to flow from the supply line, through the gap between the base 70 and the lower body member 54, out the valve system outlet port 20, through the water treatment system 11, and then back into the valve system through the valve system inlet port 22, out the treated water outlet port 18 and ultimately out the treated water faucet 30. In the closed position, the automatic shutoff 24 prevents water (or another fluid) from entering the valve system 10 by blocking the hole 63 that provides fluid flow from the supply port 14 into the valve system 10. In one embodiment, the automatic shutoff 24 includes an upper membrane 31 between the plunger 60 and the upper body member 52 and a lower membrane 33 between the base 70 of the plunger 60 and the lower body member 54. In this embodiment, the fluid flows between the membranes and the upper 52 and lower 54 body members, such that the membranes 31, 33 act to seal the plunger 60 from the fluid. As noted above, the automatic shutoff 24 operates on a pressure differential between the fluid passing under the plunger and the fluid passing over the plunger. When the faucet 30 is turned off, the check valve 25 holds pressure within the valve system above the plunger 60, forcing the plunger 60 into the closed position. When the faucet 30 is turned on, the pressure above the plunger 60 is reduced, such that the plunger 60 moves toward the upper body member 52 and into the open position, allowing fluid to flow through the valve system 10 and into the water treatment system 11. As shown in FIGS. 3 and 5, when the plunger 60 moves into the open position, fluid flows from the supply inlet port 14 through the hole 63 defined in the upper surface 65 of the lower body member 54, and into the trough 67, which is in fluid communication with the water treatment system outlet port 22. As the fluid flows through the hole 63, it engages the lower membrane 33, which pushes the plunger 60 into the open position. In the illustrated embodiment, the pressure differential required to open and close the plunger 60 may be varied as desired by changing the relative diameters of the plate 64 and the base 70. In an alternative embodiment, a different automatic shutoff system may be used for controlling the fluid flow into and out of the valve system 10.

Figure 4:
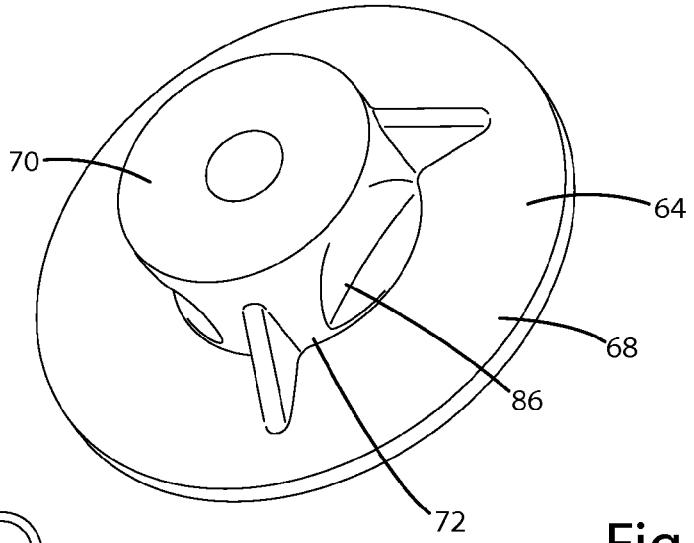
FIG. 4 is a perspective view of the plunger according to one embodiment.

In one embodiment, the automatic shutoff 24 includes a system for preventing the plunger 60 from "chatter." Chatter may arise in situations where the pressure above or below the plunger 60 changes slowly, such that the pressure remains for a period of time at about the level that will move the plunger 60 to the open position. This causes the plunger 60 to make sudden movements back and forth between the open and closed position, which can be loud and irritating and can cause the faucet 30 to drip. In the case of the present invention, a chatter situation can be created when the faucet 30 is closed, as the pressure gradually builds up on the upper surface of the plunger 60. In order to prevent chatter, the valve system 10 may include a device for mechanically holding the plunger 60 in the closed position until a significant amount of pressure is introduced to move it to the open position. As shown in FIGS. 3 and 4, in the illustrated embodiment, the valve system 10 includes a series of pins 76 containing spring loaded balls 78 that extend through holes 84 in the plunger ring 62 and fit into detents 86 in the sidewall 72 of the plunger base 70. As shown in FIG. 4, the detents 86 may have a ramped surface that biases the plunger 60 in the closed position. In this embodiment, the force on the base 70 of the plunger must overcome the force of the pressure on the plate 64, as well as the force of the spring loaded balls 78, before the plunger 60 will move to the open position. In an alternative embodiment, a different mechanical or electro-mechanical device may be used to bias the plunger 60 in either the open or closed position.

In one embodiment, the present invention additionally includes a flow controller 90 for limiting the flow of fluid entering the valve system 10, and, ultimately, for limiting the flow of fluid entering the water treatment system 11. This can ensure that the water treatment system 11 is operating to treat a desired amount of fluid—or no more than a maximum amount of fluid—at any given time. In one embodiment, the flow controller 90 is a flexible ring of material positioned proximate to the supply water inlet port 14. Other types of known flow controllers may otherwise be used.

Figure 6:
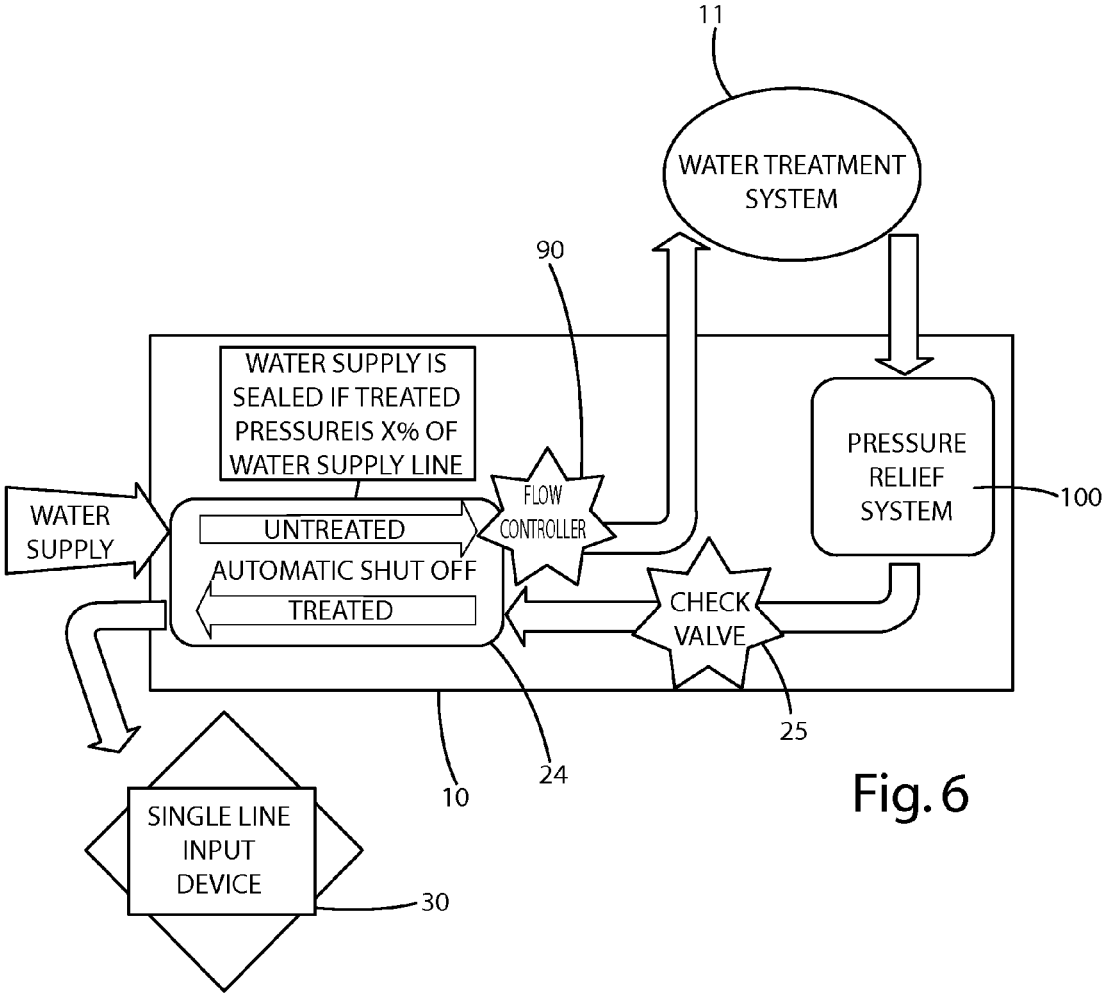
FIG. 6 is a schematic flow diagram of one embodiment of the present invention.

In another embodiment, shown in the schematic flow diagram in FIG. 6, the valve system 10 additionally includes a pressure relief mechanism 100 for relieving pressure on the water treatment system 11 when the automatic shutoff valve 24 is closed. In one embodiment, the pressure relief system 100 may be a check valve in the valve system 10, positioned between the water treatment system 11 and the check valve 25 that allows air to exit the system. In another embodiment, the pressure relief system may be an active system, such as a reservoir that uses a venturi to actively transfer pressure from the water treatment system 11 into the reservoir when the automatic shutoff 24 is closed. The pressure relief system 100 allows the water treatment system 11 to be pressure free at all times when the faucet 30 is closed, which can be especially helpful because it enables maintenance of the water treatment system 11 without the need for taking the system 11 off-line.

This may be necessary in situations where the automatic shutoff 24 cannot close fast enough to keep pressure off the water treatment system 11. The pressure relief system 100 is not necessary in cases when the automatic shutoff 24 can close fast enough to prevent such pressure (such as in the first illustrated embodiment).

Figure 7:
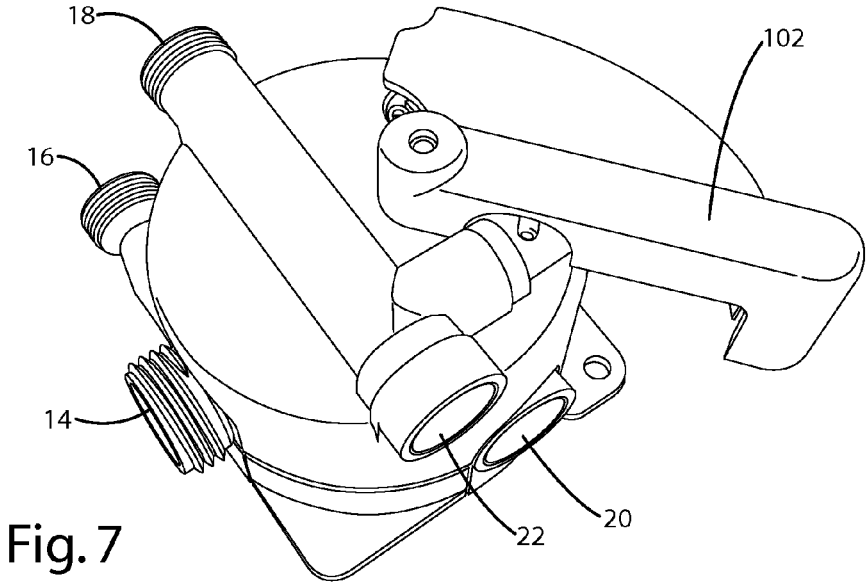
FIG. 7 is a perspective view of the faucet valve system according to another embodiment.
Figure 8:
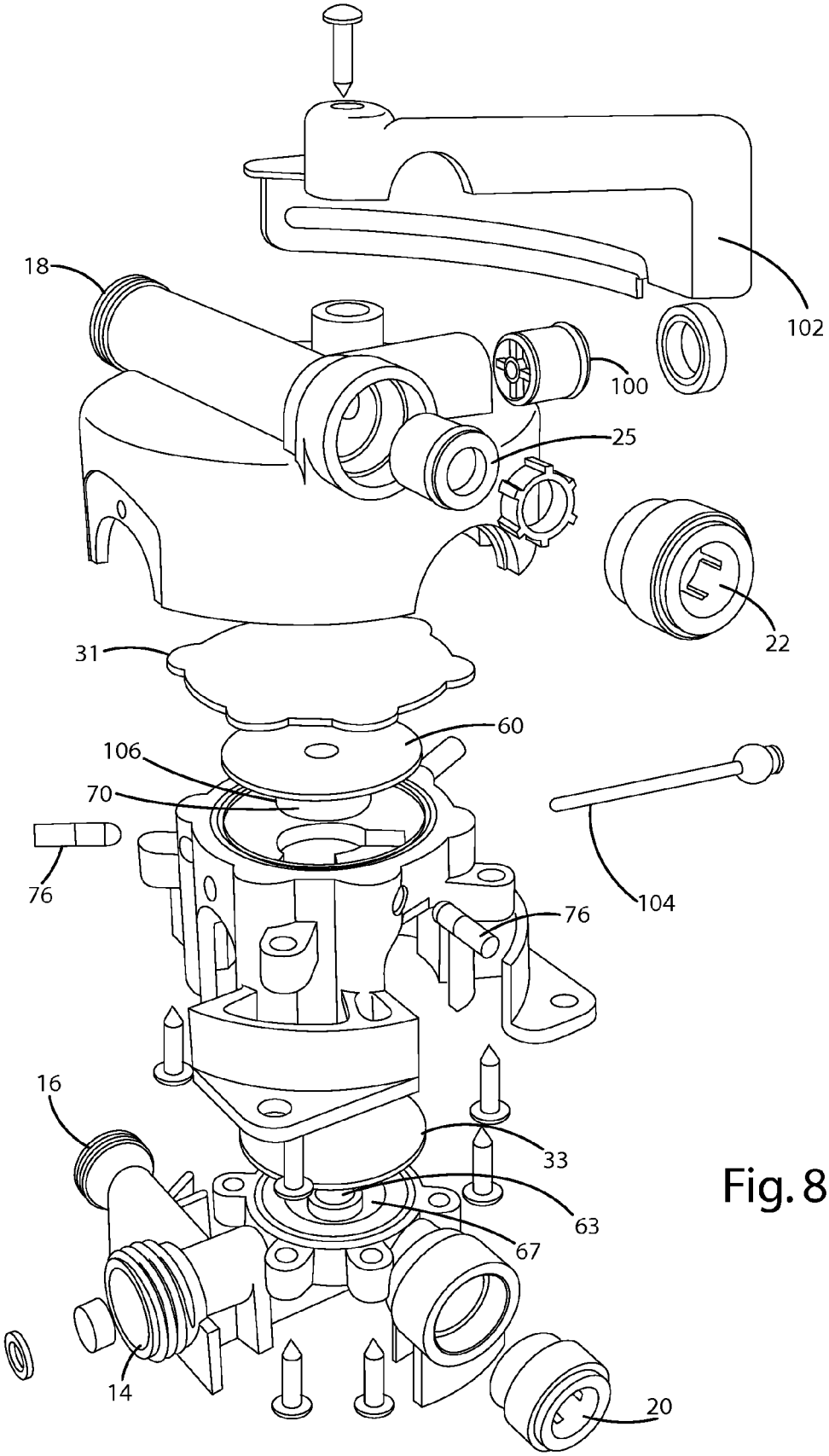
FIG. 8 is an exploded view of the faucet valve system of FIG. 7.
Figure 9:
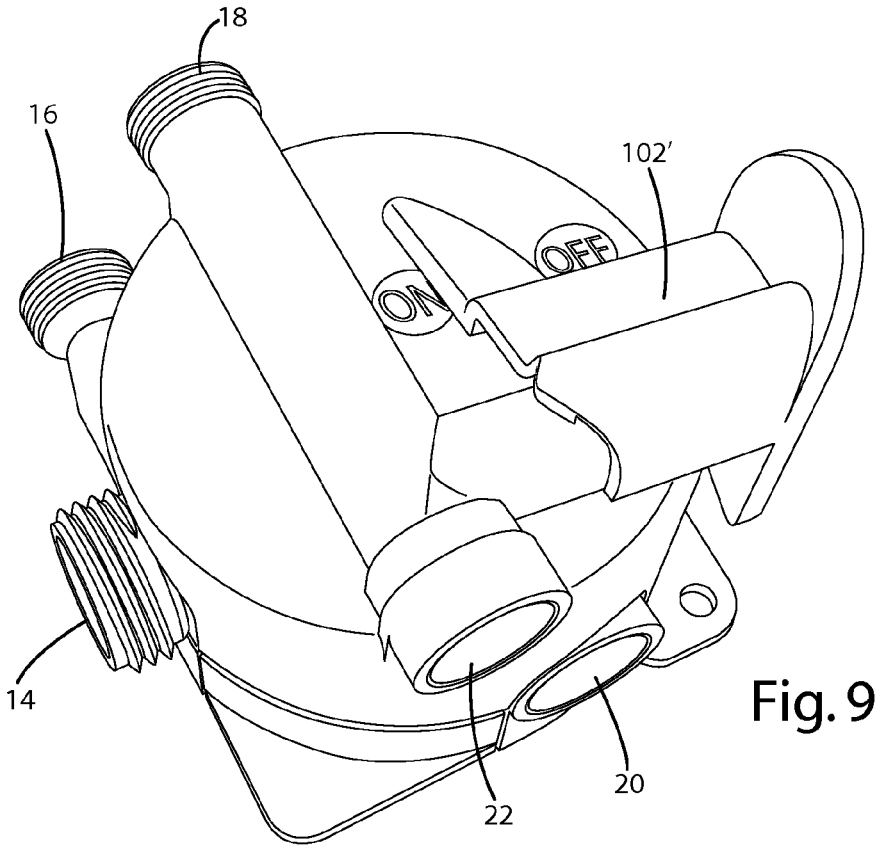
FIG. 9 is a perspective view of the faucet valve system according to another embodiment.
Figure 10:
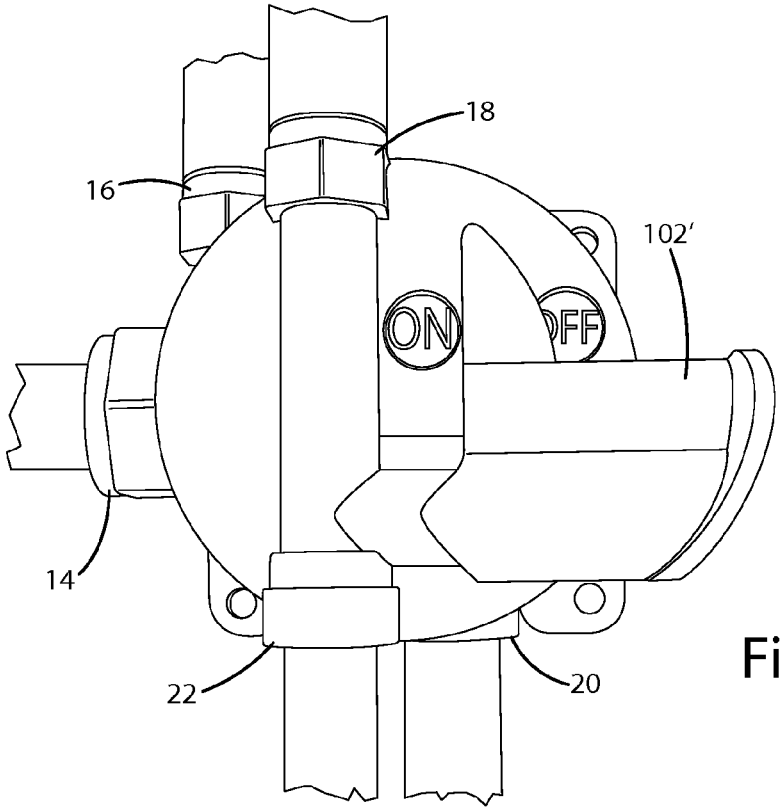
FIG. 10 is a top view of the faucet valve system of FIG. 9 showing the supply lines connected to the valve system.
Figure 11:
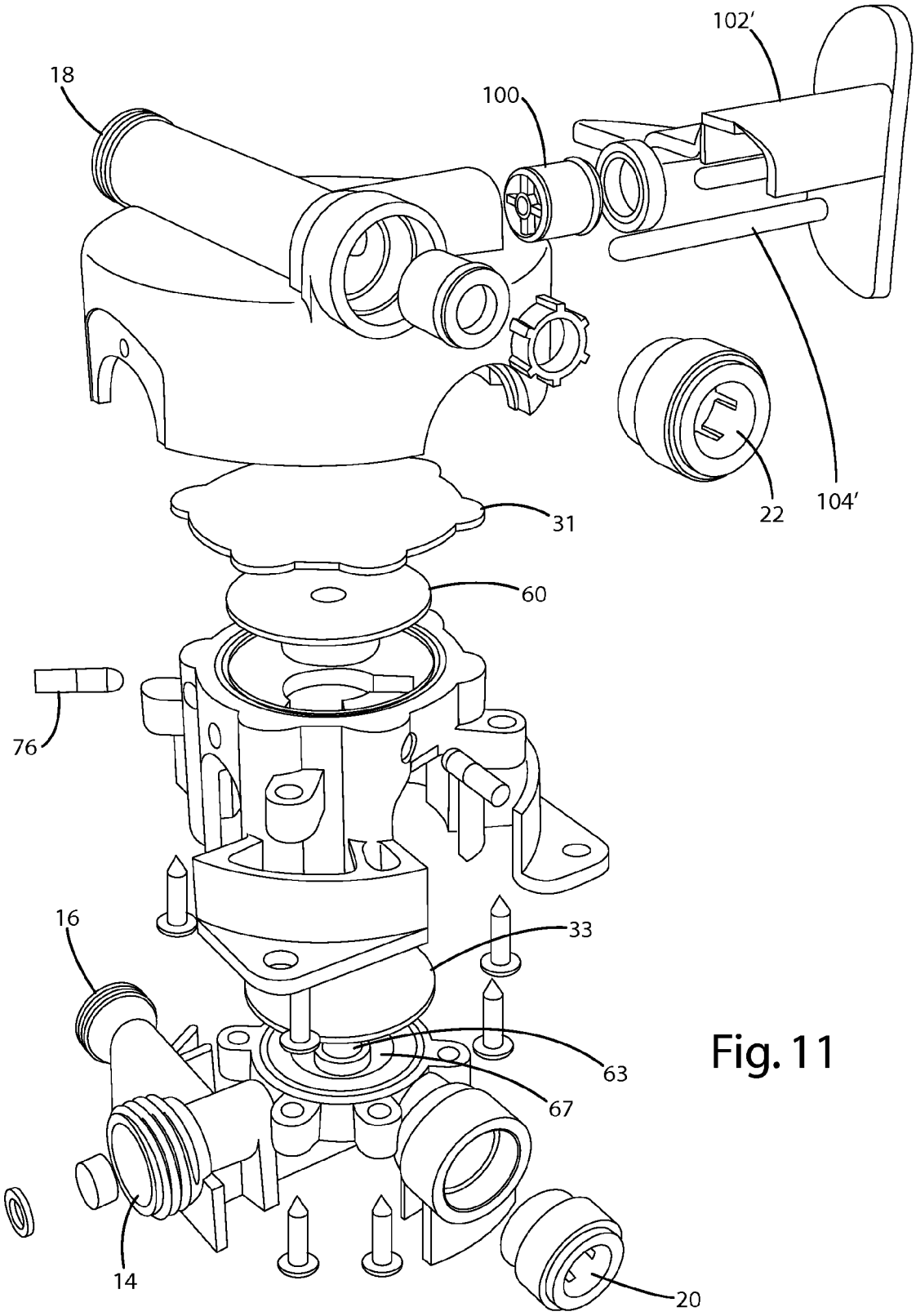
FIG. 11 is an exploded view of the faucet valve system of FIG. 9.

Alternative embodiments of the valve system are shown in FIGS. 7-8 and in FIGS. 9-11. These alternative embodiments operate in the same manner and with the same basic components as in the above described embodiment, except that the alternative embodiments include a switch for locking the valve system closed and a pressure relief system. FIGS. 7-8 show a pivoting switch 102 that engages a pin 104. The pin 104 extends through a hole (not shown) in the housing 12, and, when closed, it extends through a hole 106 in the plunger base 70 to lock the plunger 60 in the closed position. FIGS. 9-11 show a sliding switch 102' that includes a pin 104' that operates in the same manner as the pin 104. The locking mechanism can be used to prevent the plunger 60 from opening, even when the faucet 30 is turned on. This can prevent unwanted flow of water from the valve system 10, such as in situations when maintenance is being performed on the water treatment system 11. FIGS. 8 and 11 show a pressure relief system 100 that relieves the pressure in the water treatment system 11 when the faucet 30 is closed.

Although the valve system 10 is described in connection with a water treatment system 11 that includes one or more filters for treating water, the valve system may be used in connection with other devices that operate on a supply of fluid, such as a hot water heater or a water softener. In this application, the valve system 10 can be placed in-line with the device and can operate to prevent catastrophic failure, such as flooding, in the event that the downstream device malfunctions and/or leaks.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

What is claimed is:

1. A valve system for connecting a downstream fluid treatment device to a single line faucet comprising:

a housing;

a first inlet port on said housing for receiving supply fluid into the valve system;

a first outlet port on said housing in fluid communication with said first inlet port, said first outlet port for transmitting fluid out of the valve system to the downstream device;

a second inlet port on said housing for receiving fluid into the valve system from the downstream device;

a second outlet port on said housing for transmitting fluid out of the valve system to the single-line faucet; and an automatic shutoff valve in said housing in fluid communication with said first inlet port, said first outlet port, said second inlet port, and said second outlet port, wherein said shutoff valve is automatically switched from an open position to a closed position and from said closed position to said open position as a function of a pressure differential between the first inlet port and the second outlet port, said open position allowing fluid flow through said first inlet port to said first outlet port, and through said second inlet port to said second outlet port, said closed position prohibiting fluid flow from said first inlet port to said second outlet port, the valve system including a switch that prohibits said shutoff valve from placement in said open position.

2. The valve system of claim 1 including a check valve in said housing adjacent said second inlet port.

3. The valve system of claim 2 including a pressure relief mechanism between said check valve and said second inlet port capable of reducing a first pressure within said second inlet port.

4. The valve system of claim 2 wherein said check valve is capable of allowing fluid flow from said second inlet port to said second outlet port, and prohibiting fluid flow from said second outlet port to said second inlet port.

5. The valve system of claim 1 including a plunger in said shutoff valve, said plunger capable of being switched between a first position and a second position, said first position allowing fluid flow through said first inlet port to said first outlet port, and through said second inlet port to said second outlet port, said second position preventing fluid flow from said first inlet port to said second outlet port, wherein said plunger is in said first position when the pressure differential is greater than a specified value.

6. The valve system of claim 5 wherein said shutoff valve includes at least one stabilizing member, said stabilizing member biasing said plunger toward said closed position.

7. A water treatment system comprising:

a water supply;

a water treatment device;

an input device; and a valve system, including a first inlet port connected to said water supply for receiving supply fluid into said valve system, a first outlet port connected to said water treatment device for transmitting fluid out of said valve system to said water treatment device, a second inlet port connected to said water treatment device for receiving fluid into said valve system from said water treatment device, a second outlet port connected to said input device for transmitting fluid out of said valve system to said input device, and a shutoff valve in fluid communication with said first inlet port, said first outlet port, said second inlet port, and said second outlet port, wherein said shutoff valve is capable of automatically switching from an open position to a closed position and from said closed position to said open position as a function of a pressure differential between the first inlet port and the second outlet port, said open position allowing fluid flow from said first inlet port to said first outlet port and from said second inlet port to said second outlet port, said closed position prohibiting fluid flow from said first inlet port to said first outlet port, wherein the valve system includes a switch that prohibits said shutoff valve from placement in said open position.

8. The water treatment system of claim 7 wherein said valve system includes a check valve adjacent said second inlet port.

9. The water treatment system of claim 8 including a pressure relief mechanism between said check valve and said second inlet port and a first pressure within said second inlet port, wherein said pressure relief mechanism is capable of reducing said first pressure.

10. The water treatment system of claim 7 including a flow controller adjacent to said water treatment device that limits the amount of fluid flow into said water treatment device.

11. The water treatment system of claim 7 wherein said shutoff valve includes a plunger and at least one stabilizing member, said stabilizing member biasing said plunger toward said closed position.

12. The water treatment system of claim 7 wherein said shutoff valve is switched to said open position when said pressure differential is more than a specified value and said shutoff valve is switched to said closed position when said pressure differential is less than said specified value.

* * * * *